US007162988B1

(12) United States Patent
Liao

(10) Patent No.: US 7,162,988 B1
(45) Date of Patent: Jan. 16, 2007

(54) POWER-SAVING ACTIVATION DEVICE

(75) Inventor: Chia-Hsing Liao, Tao Yuan Hsien (TW)

(73) Assignee: Hsin-Chih Chung Lee, Chungli (TW)

( * ) Notice: Subject to any disclaimer, the term of this patent is extended or adjusted under 35 U.S.C. 154(b) by 0 days.

(21) Appl. No.: 11/488,794

(22) Filed: Jul. 19, 2006

(51) Int. Cl.
*F02N 5/02* (2006.01)
*F02N 3/02* (2006.01)

(52) U.S. Cl. ..... 123/185.14; 123/185.3

(58) Field of Classification Search ..... 123/185.14, 123/185.2, 185.3, 185.4
See application file for complete search history.

(56) References Cited

U.S. PATENT DOCUMENTS 5,287,832 A * 2/1994 Uhl ..... 123/185.3
6,827,055 B1 * 12/2004 Tsunoda et al. ..... 123/185.14
7,114,479 B1 * 10/2006 Lee ..... 123/185.3
2002/0121258 A1 * 9/2002 Nieda et al. ..... 123/185.14
2002/0139341 A1 * 10/2002 Tsuno ..... 123/185.3
2002/0157632 A1 * 10/2002 Nemoto et al. ..... 123/185.14
2002/0174848 A1 11/2002 Nieda et al. ..... 123/185.14
2004/0016311 A1 * 1/2004 Hashiba ..... 74/8
2004/0065289 A1 4/2004 Leasure et al. ..... 123/185.14
2004/0123827 A1 7/2004 Tsunoda et al. ..... 123/185.3
2004/0123828 A1 * 7/2004 Sing et al. ..... 123/185.14
2005/0252477 A1 * 11/2005 Schriever et al. ..... 123/185.14

* cited by examiner

*Primary Examiner*—Stephen K. Cronin
*Assistant Examiner*—Arnold Castro
(74) *Attorney, Agent, or Firm*—Rabin & Berdo, P.C.

(57) ABSTRACT

An activation device for activating an engine of a power tool includes an activation unit, a clutch unit and a transmission unit, wherein the clutch unit is connected between the activation unit and the transmission unit. The activation unit includes a first spring disk and a second spring disk. When the activation unit rotates clockwise, the transmission unit rotates in the same direction via the clutch unit. When the first spring disk releases the energy to rotate the activation unit counter clockwise, the clutch unit disengages the activation unit from the transmission unit so that the second spring disk rotates the transmission unit to start the engine.

6 Claims, 5 Drawing Sheets

POWER-SAVING ACTIVATION DEVICE

BACKGROUND OF THE INVENTION

1. Field of the Invention

The present invention relates to a power-saving activation device which requires less effort to activate an engine of a power tool.

2. The Prior Arts

Most conventional power tools such as mowers and trimmers are powered by an engine which is activated by pulling a cable by the user. The cable is wound to a wheel which is connected with a spring unit so that when the cable is pulled, the wheel drives the spring unit to activate the engine. After pulled, the cable is pulled back by the spring unit and then is rewound to the wheel again. The inherent shortcoming for this type of activation device is that the user has to pull the cable hard and the resistance is so significant that some users have difficulties to activate the engine. Another shortcoming is that the user has to pull the cable several times to successfully activate the engine. U.S. Patent Publication No. 2002/0,121,258A1, 2002/0,174,848A1, 2004/0,065,289A and 2004/0,123,827A1 provide some methods and devices to improve the shortcomings.

The present invention intends to provide an activation device for activating the engine with less effort so that users can easily and successfully activate the engine.

SUMMARY OF THE INVENTION

In accordance with the present invention, an activation device for activating an engine of a power tool includes an activation unit, clutch unit and a transmission unit. The activation unit has a casing with a center shaft on which a first spring disk and a cable wheel are respectively mounted thereto. A handle is connected with a cable and located on outside of the casing. A first end of the first spring disk is secured to the center shaft and a second end of the first spring disk is secured to the casing. A first recess is defined in a side of the cable wheel and a polygonal rod extends from a surface defining the first recess.

The clutch unit includes a rotation member and a driving member, wherein the rotation member has a second recess defined in a first side thereof and a plurality of notches are defined in an inner periphery of the second recess. A tubular portion extends from a second side of the rotation member. The driving member has a through hole through which the polygonal rod extends. Two teeth extend from two opposite ends of the driving member and each tooth includes a slip face and a stop face.

The transmission unit includes a second spring disk and a pawl disk, wherein the second spring disk is connected to the second side of the rotation member. The pawl disk has a tubular member extending from a first side thereof and a passage is defined longitudinally through the tubular member. A plurality of pawls extend from an outer periphery of the tubular member. The tubular portion of the rotation member is loosely inserted in the passage of the tubular member. The second spring disk has two ends thereof connected to the pawl disk and the rotation member respectively. The pawl disk is connected to the center shaft by a bolt.

When the activation unit is operated to rotate clockwise, it drives the transmission unit via the clutch unit so that the two spring disks store energy simultaneously. When the first spring disk release the energy to rotate the activation unit counter clockwise, the clutch unit disengages the activation unit from the transmission unit, so that the second spring disk rotates the transmission unit so as to activate the engine connected with the transmission unit. By the activation device, the user can easily start the engine with less effort.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
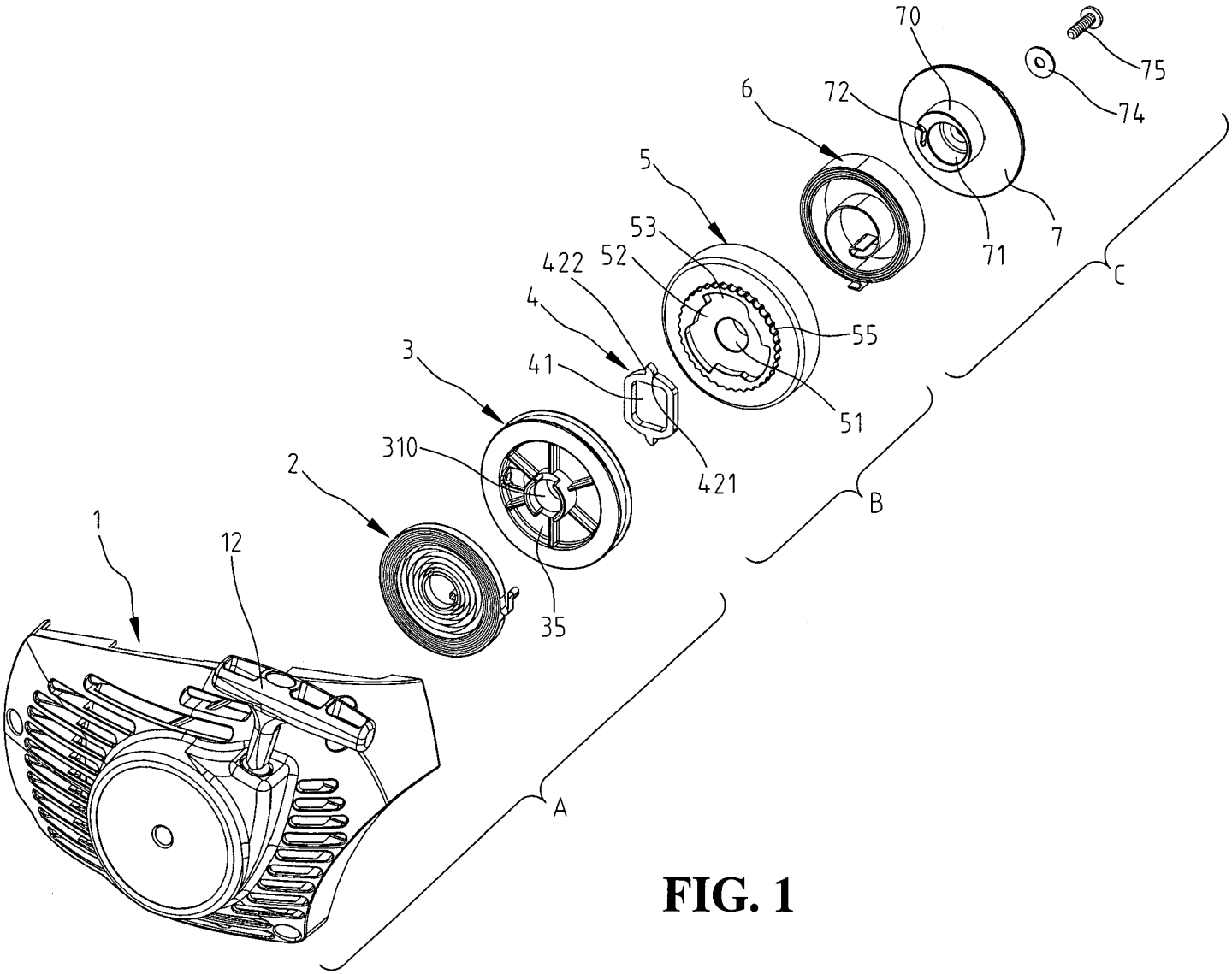
FIG. 1 is an exploded perspective view of an activation device according to the present invention.
Figure 2:
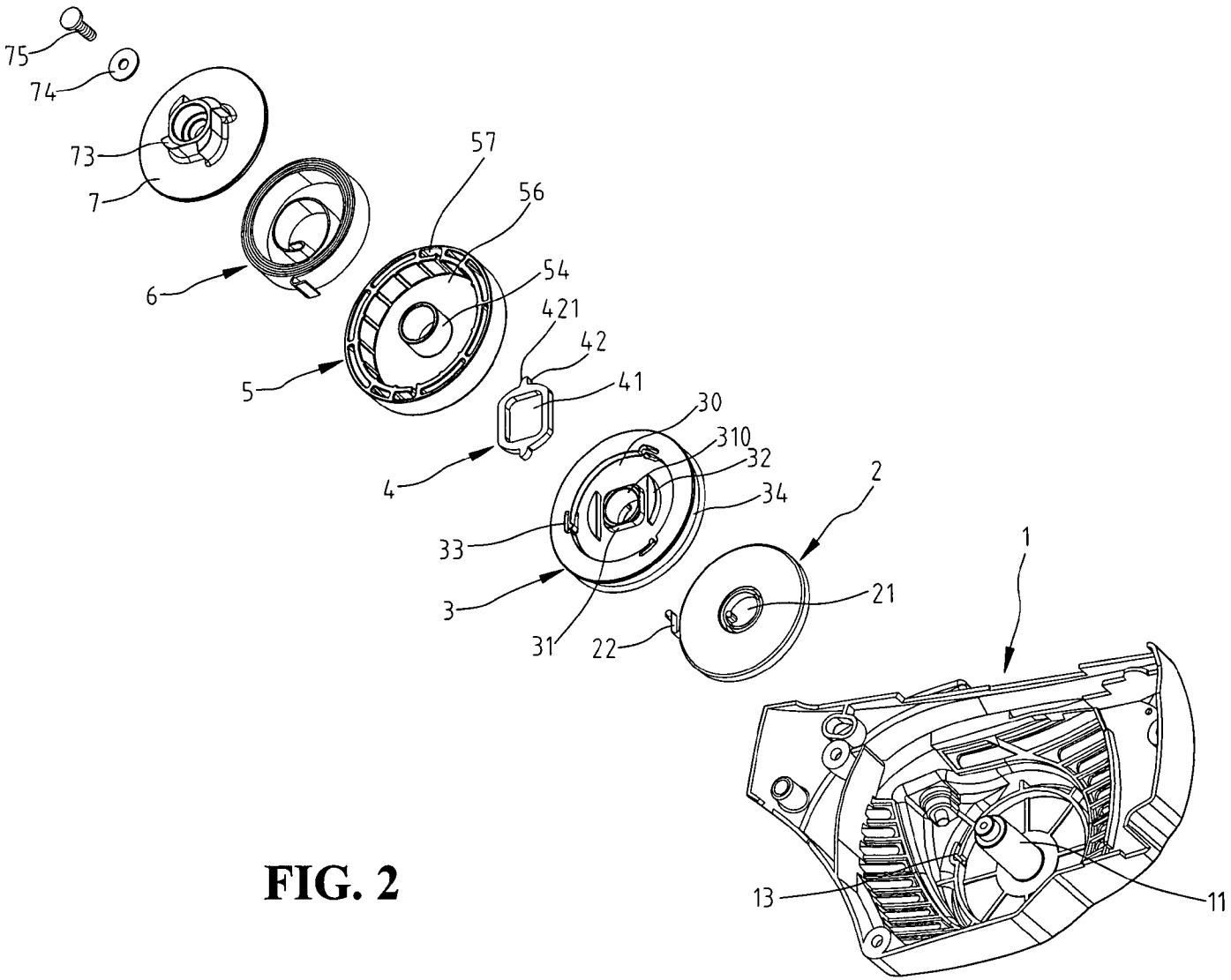
FIG. 2 is an exploded perspective view showing the activation device of FIG. 1 from another angle of view.
Figure 3:
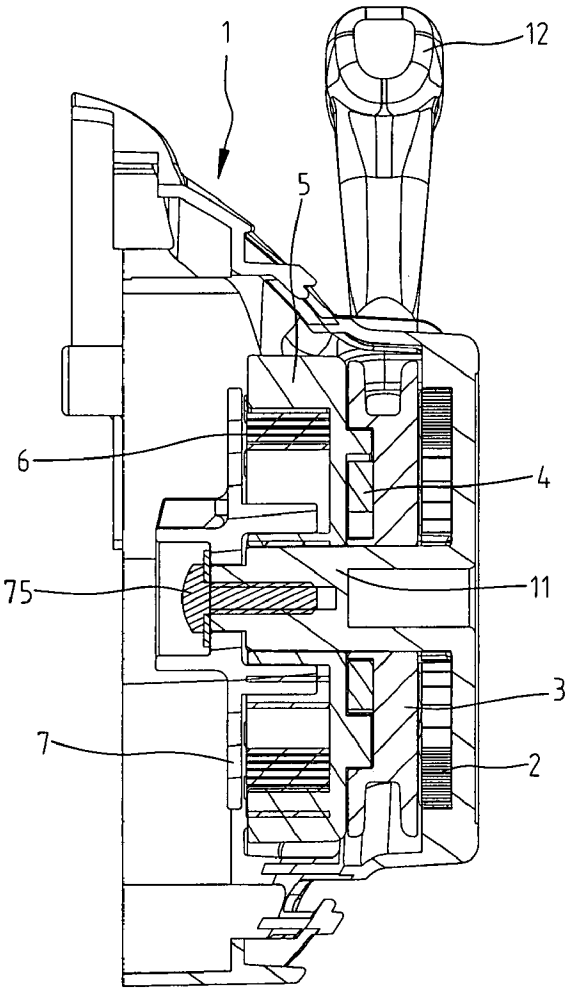
FIG. 3 is a cross sectional view showing the activation device of the present invention.

Referring to FIGS. 1–3, an activation device for activating an engine of a small power tool in accordance with the present invention comprises an activation unit A, a clutch unit B and a transmission unit C. The activation unit A includes a casing 1 with a center shaft 11, a handle 12 connected with a cable, a first spring disk 2 and a cable wheel 3. A cable is wound to the cable wheel 3 and engaged with the groove 31 in the cable wheel 3. The cable wheel 3 has a first side facing the casing 1, and a second side. A first recess 30 is defined in the second side of the cable wheel 3 and a polygonal rod 31 extends from a surface defining the first recess 30. A central hole 310 is defined longitudinally through the polygonal rod 31. Two protrusions 32 extend from the surface of the first recess 30 of the cable wheel 3. The first recess 30 of the cable wheel 3 further has a plurality of stubs 33 extending therefrom. The first spring disk 2 and the cable wheel 3 are mounted on the center shaft 11. A first end 21 of the first spring disk 2 is secured to a slit 13 defined in the casing 1, and a second end 22 of the first spring disk 2 is secured to an engaging hole 35 defined in the first side of the cable wheel 3. The handle 12 is located on an outside of the casing 1 and is connected with the cable so that the user can easily hold the handle 12 and pull.

The clutch unit B includes a rotation member 5 and a driving member 4, wherein the rotation member 5 has a second recess 52 defined in a first side thereof and a plurality of notches 53 are defined in an inner periphery of the second recess 52. A tubular portion 54 extends from a second side of the rotation member 5.

A gear 55 is connected to the first side of the rotation member 5 and the second recess 52 is defined in the gear 55 which is engaged with the first recess 30 of the cable wheel 3. The stubs 33 are engaged with teeth of the gear 55.

The driving member 4 has a rectangular through hole 41 so as to form a rectangular frame, and the polygonal rod 31 extends through the through hole 41 and can co-rotate the driving member 4. A distance between each of the two protrusions 32 and the polygonal rod 31 is the same as a width of the frame of the driving member 4, so that the rectangular frame of the driving member 4 is engaged between the two protrusions 32 and the polygonal rod 31. Two teeth 42 extend from two opposite ends of the driving member 4 and each tooth 42 includes a slip face 421 and a stop face 422. The slip face 421 can be an inclined surface or a curved surface. The stop face 422 is perpendicular to the rectangular frame of the driving member 4.

The transmission unit C includes a second spring disk 6 and a pawl disk 7. The second spring disk 6 is connected to the second side of the rotation member 5. The pawl disk 7 has a tubular member 70 extending from a first side thereof and a passage 71 is defined longitudinally through the tubular member 70. A plurality of pawls 73 extends from an outer periphery of the tubular member 70. The tubular portion 54 of the rotation member 5 is loosely inserted in the passage 71 of the tubular member 70. The second spring disk 6 has two ends thereof connected to dents 57 defined in a periphery of a recessed area 56 in the rotation member 5 and engaging notches 72 in the pawl disk 7, respectively. The pawl disk 7 is connected to the center shaft 11 by a bolt 75 cooperated with a washer 74.

Figures 4A, 4B, 4C:
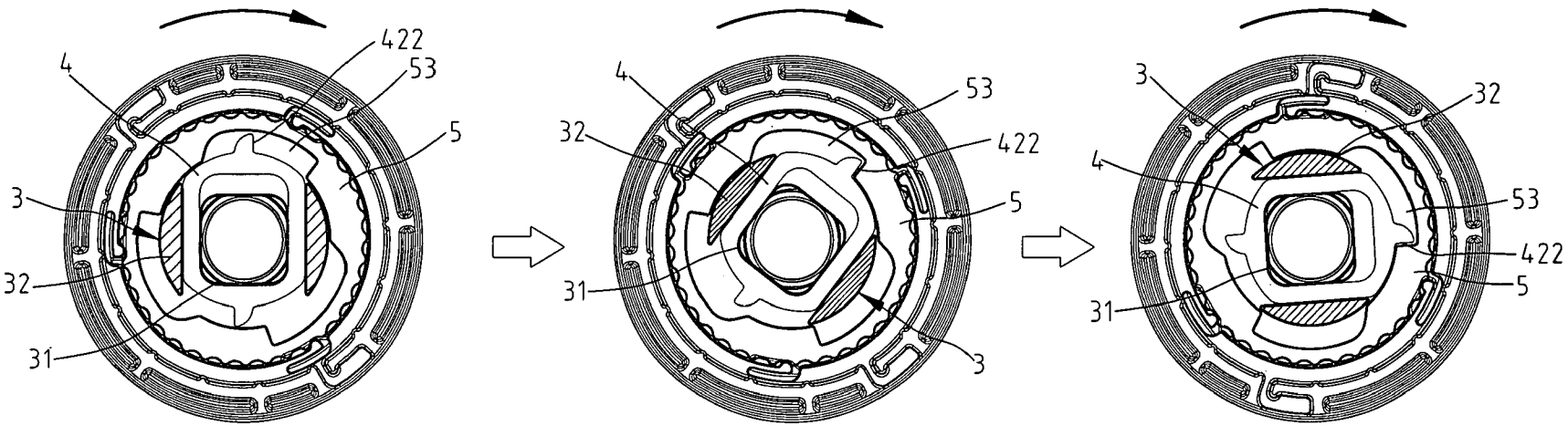
FIGS. 4A–4C show that when a cable wheel rotates clockwise, a rotation member rotates clockwise by a driving member.

As shown in FIGS. 4A–4C, when the user holds the handle 12 and pulls the handle 12 so that the cable drives the cable wheel 3 to rotate clockwise as shown in FIG. 4A, the polygonal rod 31 and the driving member 4 are rotated clockwise with the cable wheel 3. The stop faces 422 of the teeth 42 are then in contact with the end surfaces of the notches 53 of the rotation member 5 as shown in FIG. 4B. The rotation member 5 rotates clockwise too as shown in FIG. 4C. The stubs 33 prevent the rotation member 5 from freely rotating by vibration such that the center shaft 11 can be avoided from wearing. In the meanwhile, the first and second spring disks 2, 6 store energy.

Figures 5A, 5B, 5C, 5D:
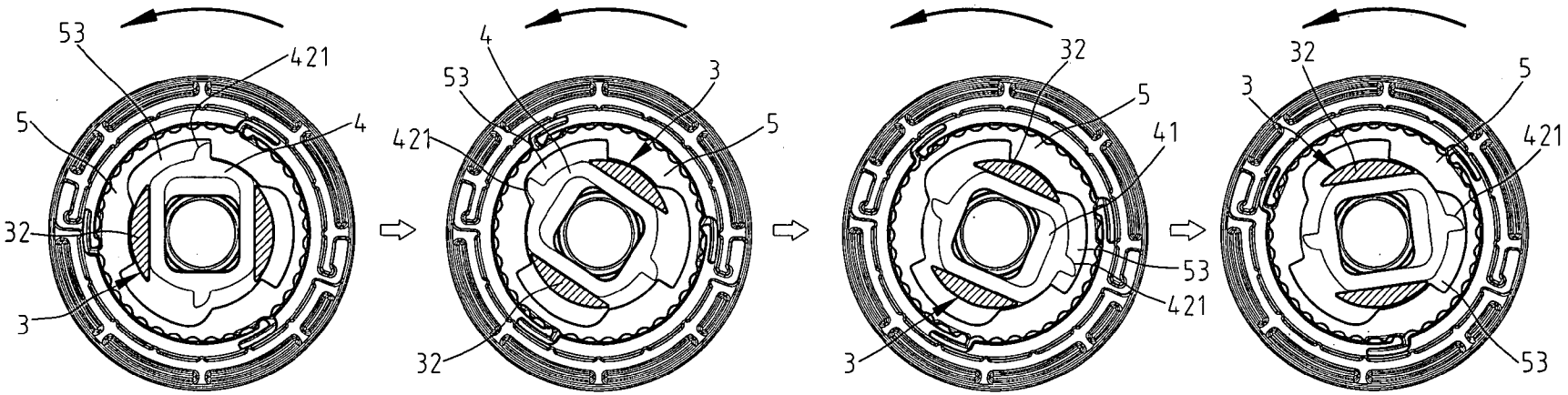
FIGS. 5A–5D show that when the cable wheel rotates counter clockwise, the rotation member is isolated from rotation of the driving member.

When the user releases the handle 12, the stored energy in the first spring disk 2 rotates the cable wheel 3 to rotate counter clockwise as shown in FIG. 5A and the driving member 4 is rotated counter clockwise too. When the slip faces 421 of the teeth 42 of the driving member 4 are in contact with the end surface of the notches 53 of the rotation member 5 as shown in FIG. 5B, the slip faces 421 move over the end surfaces of the notches 53 as shown in FIGS. 5C and 5D until the driving member 4 stops. In other words, the cable wheel 3 does not drives the rotation member 5 when the cable wheel 3 rotates counter clockwise, so that the stored energy in the second spring disk 6 drives the rotation member 5 and the pawl disk 7 which has pawl members 73 connected with the engine so that the engine can be activated.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An activation device comprising:

an activation unit having a casing with a center shaft, a handle connected with a cable, a first spring disk and a cable wheel, the first spring disk and the cable wheel mounted on the center shaft, a first end of the first spring disk secured to the casing and a second end of the first spring disk secured to the cable wheel, the handle located on an outside of the casing, the cable wheel having a first side and a second side, a first recess defined in the second side of the cable wheel and a polygonal rod extending from a surface defining the first recess;

a clutch unit having a rotation member and a driving member, the rotation member having a second recess defined in a first side thereof and a plurality of notches defined in an inner periphery of the second recess, a tubular portion extending from a second side of the rotation member, the driving member having a through hole and the polygonal rod extending through the through hole, two teeth extending from two opposite ends of the driving member and each tooth including a slip face and a stop face; and a transmission unit including a second spring disk and a pawl disk, the second spring disk connected to the second side of the rotation member, the pawl disk having a tubular member extending from a first side thereof and a passage defined longitudinally through the tubular member, a plurality of pawls extending from an outer periphery of the tubular member, the tubular portion of the rotation member loosely inserted in the passage of the tubular member, the second spring disk having two ends thereof connected to the pawl disk and the rotation member respectively, the pawl disk connected to the center shaft by a bolt.

2. The device as claimed in claim 1, wherein the first recess of the cable wheel has a plurality of stubs extending therefrom and a gear is connected to the first side of the rotation member, the second recess is defined in the gear which is engaged with the first recess of the cable wheel, the stubs are engaged with teeth of the gear.

3. The device as claimed in claim 1, wherein the slip face of the driving member is an inclined surface.

4. The device as claimed in claim 1, wherein the slip face of the driving member is a curved surface.

5. The device as claimed in claim 3, wherein two protrusions extend from the surface of the first recess of the cable wheel and a distance between each of the two protrusions and the polygonal rod is the same as a width of a frame of the driving member.

6. The device as claimed in claim 4, wherein two protrusions extend from the surface of the first recess of the cable wheel and a distance between each of the two protrusions and the polygonal rod is the same as a width of a frame of the driving member.

* * * * *